US005720572A

United States Patent [19]

Richer

[11] Patent Number: 5,720,572

[45] Date of Patent: Feb. 24, 1998

[54] ROAD ELEMENTS, AND METHOD OF AND DEVICE FOR TRANSFERRING SAME

[76] Inventor: Gilles E. Richer, 326 Ellerton St., Ville Mont-Royal, Quebec, Canada, H3P 1E2

[21] Appl. No.: 628,520

[22] Filed: Apr. 5, 1996

[30] Foreign Application Priority Data

May 17, 1995 [FR] France ..... 95 058848

[51] Int. Cl.[6] ..... E01F 15/10

[52] U.S. Cl. ..... 404/6

[58] Field of Search ..... 404/6, 7, 72, 73; 104/89, 95; 256/1, 13.1

[56] References Cited

U.S. PATENT DOCUMENTS

| | | | |
|---|---|---|---|
| 4,500,225 | 2/1985 | Qiuttner | 404/6 |
| 4,666,332 | 5/1987 | Burgett | 404/6 |
| 4,881,845 | 11/1989 | McKay | 256/13.1 |
| 5,007,763 | 4/1991 | Burgett | 404/6 |

FOREIGN PATENT DOCUMENTS

| | | | |
|---|---|---|---|
| 256996 | 2/1988 | European Pat. Off. | 104/89 |
| 2562575 | 11/1985 | France | 404/6 |
| 2306385 | 8/1974 | Germany | 104/89 |
| 2358445 | 10/1974 | Germany | 104/89 |

*Primary Examiner*—Tamara L. Graysay
*Assistant Examiner*—Tony Boyd
*Attorney, Agent, or Firm*—Ilya Zborovsky

[57] ABSTRACT

Successive road elements of a road barrier, a partition or the like are turnable relative to one another by means of hinge elements connected to their facing walls. They can be transferred by a device having a substantially C-shaped hollow guiding element with opposite ends spaced from one another in a transverse direction, and a plurality of carts each having a substantially vertical shaft articulately connected with two successive road elements in the area of the two successive road elements, so that when the guiding element is longitudinally displaced, the carts are displaced inside the guiding element without engagement of the road elements with the guiding element, and the carts with the successive road elements are transferred from the area of one end to the area of the other end of the guiding element transversely.

10 Claims, 5 Drawing Sheets

ROAD ELEMENTS, AND METHOD OF AND DEVICE FOR TRANSFERRING SAME

BACKGROUND OF THE INVENTION

The present invention relates generally to road elements and to a method of and a device for transferring the road elements.

Road elements, such as for example movable modular elements are used for example to form partitions between tracks on roadways, to form narrowing of the roadway, to protect working personnel on the roadway, etc.

Methods and devices for transferring the barriers are known in the art. One solution is proposed for example in the patent document U.S. Pat. No. 2,931,279. This patent discloses a conveyance vehicle which displaces and lifts a row of modular elements step by step by means of a C-shaped conveyor duct, and drops the modular elements step by step at a new site. This widely known barrier and its installation method have been subsequently adapted for concrete modular elements having short length and provided with two longitudinal walls which are used for rotating of the wheels of the conveyance duct, so as to keep the modular elements suspended in the course of their passage in the conveyor ducts. Such solutions are disclosed for example in the patent documents U.S. Pat. No. 4,624,601, U.S. Pat. No. 4,500,225, U.S. Pat. No. 4,498,803 and CA-A-1,208,469. These solutions allow only the use of concrete modular elements having a relatively short length of one meter, to maintain a conveyor duct of acceptable length, in view of the curves of the section of the C-shaped duct. The manufacture of the modular elements with their walls is rendered expensive, and the walls which are wider for the security of the transfer are subject to damage in case of accidents and during transfer and transport. These walls which generally form projections outside the modular element are moreover an aggravating source of accidents for the vehicles colliding with the barriers. Moreover, the barriers have a transverse resistance which is not sufficient since they are made up of a chain of short links and the installation is kept steady with difficulties. The transfer device is also subject to vibrations and is very noisy.

The use of modular elements having greater length such as three meters and more, makes it possible to remove the disadvantages of the known barriers and economize large movements between the elements. Some solutions for the transfer of such long elements are disclosed for example in the patent documents U.S. Pat. No. 4,955,753 and U.S. Pat. No. 5,074,704. The elements at their central points are provided with a cable projecting toward the top and ending in a wide head. In this solution the transfer of the elements moving among themselves is performed by a vehicle provided with an 8-shaped conveyance beam with a multiplicity of four-wheel carts linked together by a chain or a cable circle. Each cart has an arm extending toward the bottom and ending in an electrical extension socket. Provisions are made to time the plates in and out with the wide head of a modular element. This system has serious disadvantages and for this reason it has not been implemented. The fastening of the cables on the modular elements has to be perfectly centered, and it brings about deterioration by creating a wig zone in the middle of each modular element. The conveyance device is extremely complicated and its operation is far from being certain. In particular the patent documents are silent on the issues of the gauge absorption or the gauge differences between two successive cables and the modular elements move in a straight line or when they are on a curve.

SUMMARY OF THE INVENTION

Accordingly, it is an object of the present invention to provide road elements, as well as a method of and a device for transferring the road elements, which avoids the disadvantages of the prior art.

In keeping with these objects and with others which will become apparent hereinafter, one feature of the present invention resides, briefly stated, in road elements which have cooperating hinge members arranged on the facing surfaces of the road elements and engageable by a member of a transferring device which lifts and transfers the road elements from one location to another.

It is also an object of the present invention to provide a method of transferring a plurality of road elements by the steps of connecting a plurality of carts to a plurality of pairs of successive road elements so that each of the carts is articulately connected to two successive road elements by substantially vertical shaft extending between the two successive road elements, and displacing a substantially C-shaped hollow guiding element having two opposite ends spaced from one another in a transverse direction and a curved portion extending between the ends so that the carts guidingly move inside the guiding element along the guiding element from one of the ends to the other of the ends without engagement of the road elements with the guiding element, and therefore each cart with a respective one of the shafts transfers a respective one of the two road elements from the location of one end of the guiding element to the location of the other end of the guiding element.

Another feature of the invention is a device for transferring a plurality of road elements which has a substantially C-shaped hollow guiding element having two opposite ends spaced from one another in a transverse direction and a remaining curved portion extending between the ends, a plurality of carts which are guided inside the guiding elements along the guiding element from one of the ends to the other of the ends without engagement of the road elements with the guiding element, so that when the guiding element is displaced in a longitudinal direction the carts are guidingly moved from one of the ends to the other of the ends, and means for connecting each of the carts with two successive road elements, so that during the longitudinal displacement of the guiding element the two successive road elements are displaced by the carts from the one end to the other end of the guiding element, the connecting means including a substantially vertical shaft extending from each of the carts and articulately connected with the two successive road elements outside the two successive road elements.

When the method is performed and the device is designed in accordance with the present invention, adaptation to all existing road barriers and to all forms of modular elements is possible since the connecting means for connecting the cart to the road elements are mounted outside the road elements and therefore do not damage them. The cart and the shaft can be easily dismantled which is a great advantage in particular for the yards where the barriers remain for a long time at the same site. The wall composed of a plurality of the barriers can be transferred fast without vibrations or shocks.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
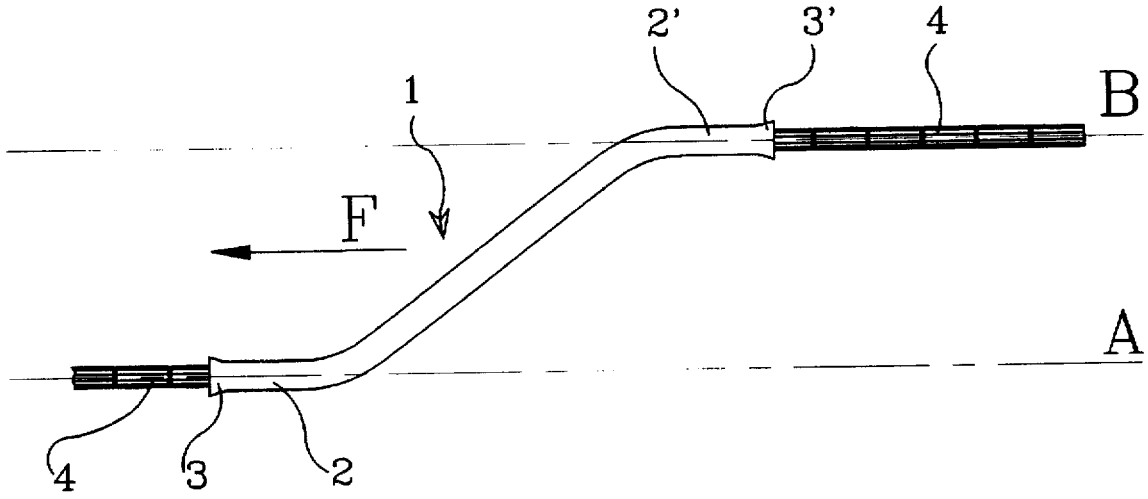
FIG. 1 is a plan view schematically illustrating a method of and a device for transporting a plurality of road elements in accordance with the present invention.
Figure 1A:
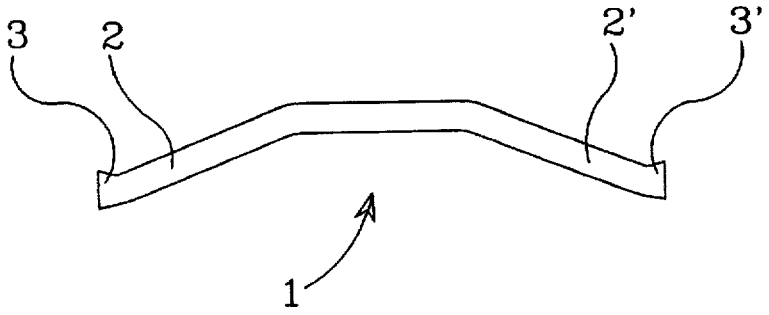
FIG. 1A is a side view of the guiding element of the device in accordance with the present invention.
Figure 2A:
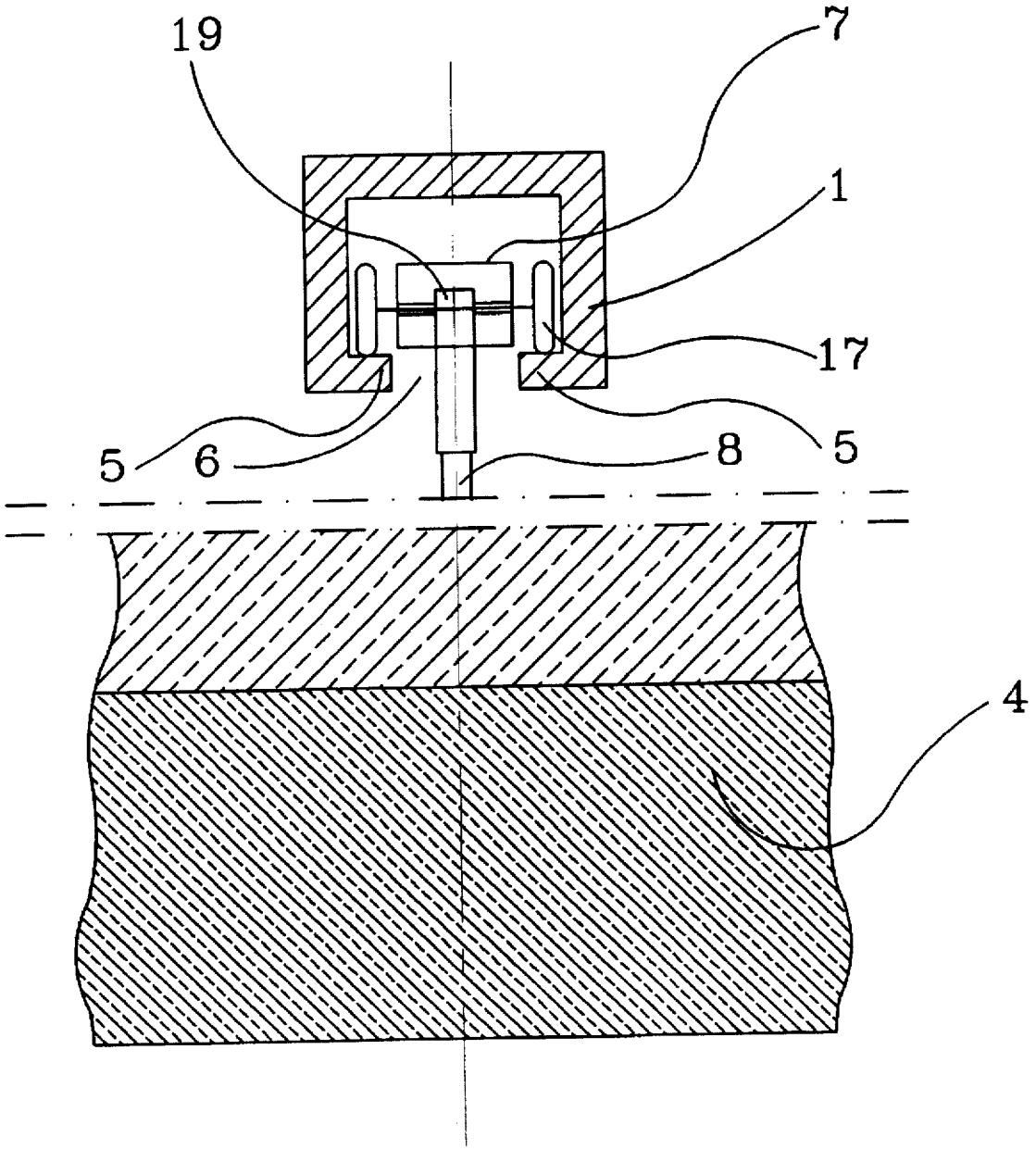
FIGS. 2A and 2B are a front view and a side view showing the inventive device cooperating with two road elements.
Figure 2B:
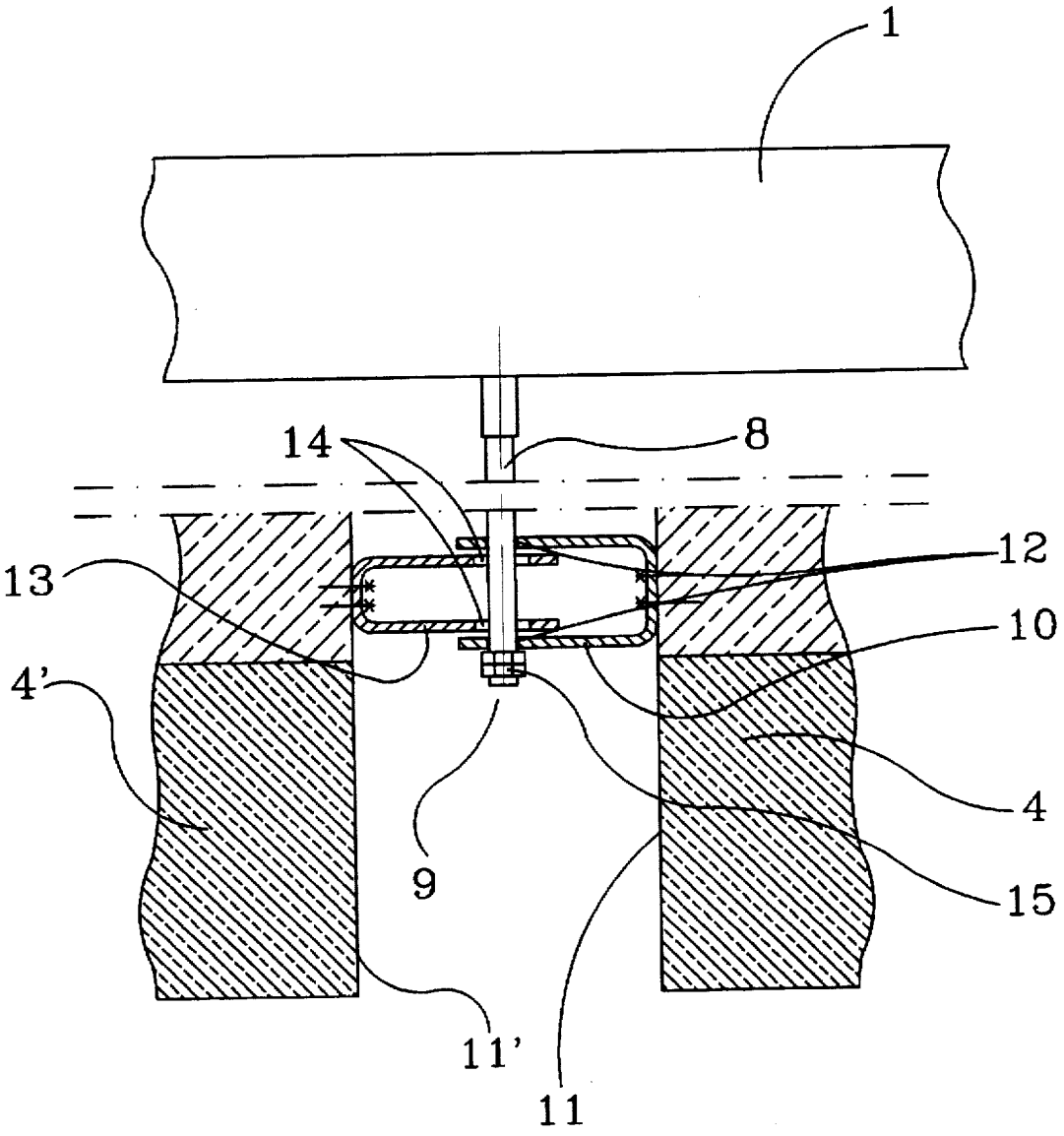

A device for transferring road elements includes a hollow guiding element which is identified as a whole with reference numeral 1. The guiding element is C-shaped and has a central curved part and two rectilinear end parts 2 and 2' each having an end 3, 3' formed as a funnel. The guiding element 1 is mounted on a not shown vehicle which can be motorized, but preferably is towed. The device is designed for transferring a wall, a partition, a barrier, etc. composed of a plurality of modular road elements. The transfer of the road elements is performed by displacement of the guiding element 1 in direction of the arrow F as will be explained herein below. As a result, the road elements are transferred from the location identified with the line A to a parallel location identified with the B as shown in FIG. 1.

The guiding element has a C-shaped cross-section which is open downwardly so as to form two blades 5 which are separated from one another by a slot 6.

The inventive device further has a plurality of carts which is identified as a whole with reference numeral 7. A shaft 8 extends downwardly from each cart and fixed to an articulation 9 between two successive road elements 4. In accordance with a preferred and practical embodiment the shaft 8 forms an axis of the articulation 9. The articulation includes a first U-shaped hinge 10 which has two legs and a connecting portion attached to a surface 11 of the road element 4 by bolts. The legs of the hinge 10 are provided with aligned holes 12, through which the shaft 8 passes. The articulation 9 further has a second U-shaped hinge 13 provided with two legs and a connecting portion connected to a surface 11' of the adjacent road element 4 by bolts. The legs of the hinge 13 are provided with oblong holes 14 which are in alignment with the holes 12 of the hinge 10 so that the shaft 8 can pass through the aligned holes 12, 14 of the hinges 10, 13. The road elements 4, 4' can turn relative to one another around a vertical axis and the turning is limited by stopping of the hinge 13 against the hinge 10. The lower end of the shaft 8 can be fixed for example by a nut 15 which is screwed on a threaded lower portion of the shaft.

The upper end of the shaft 8 is attached to a frame 16 of the cart 7. The frame is supported by four wheels 17. In the shown example the frame 16 is formed as a section of a tube portion provided with a longitudinal window 18 on its lower side for passage of a plate 19 which forms an extension of the shaft 8. The plate 19 is turnably mounted on an axle 20 extending across the middle of the frame 16. The axles 21 of the wheel 17 are parallel to the axle 20 and are located at both sides of the axle 20 at equal distances from the latter. Therefore, the frame 16 and the cart 7 can oscillate around the axle 20, while the shaft 8 stays perfectly vertical due to the road element 4 which forms the suspended mass. The oscillation is limited by the length of the longitudinal window 18.

In accordance with another modification of the present invention, it is possible to provide the cart with only two wheels 17. In this case the shaft 8 is directly fixed to the frame 16 which has no window and which oscillates around the axle 21 of the two wheels 17.

The wheels 17 can be mounted on rotating blocks or water-proof needle bearings and their number depends on the load applied by the road element 4. The road element is usually composed of concrete and formed as a solid element or can be composed of several parts of different materials.

Figure 3A:
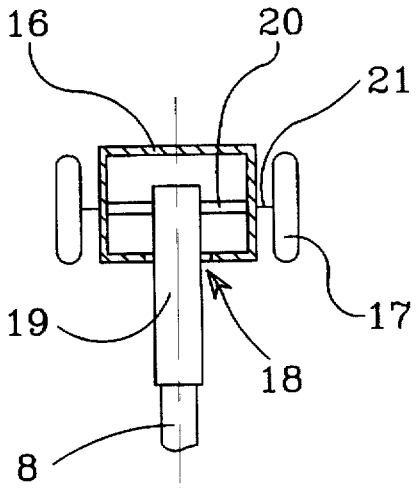
FIGS. 3A, 3B and 3C are a front view, a side view and a plan view of a cart of the device in accordance with the present invention.
Figure 3B:
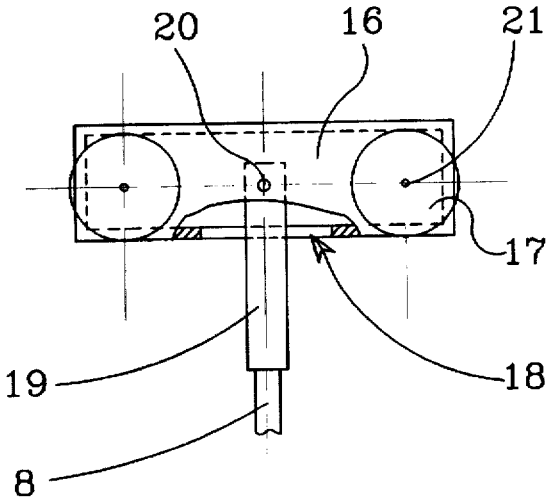
Figure 3C:
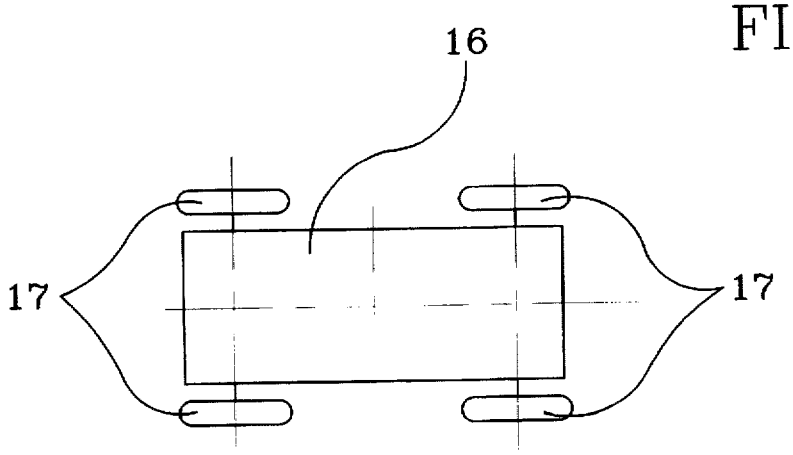
Figure 4:
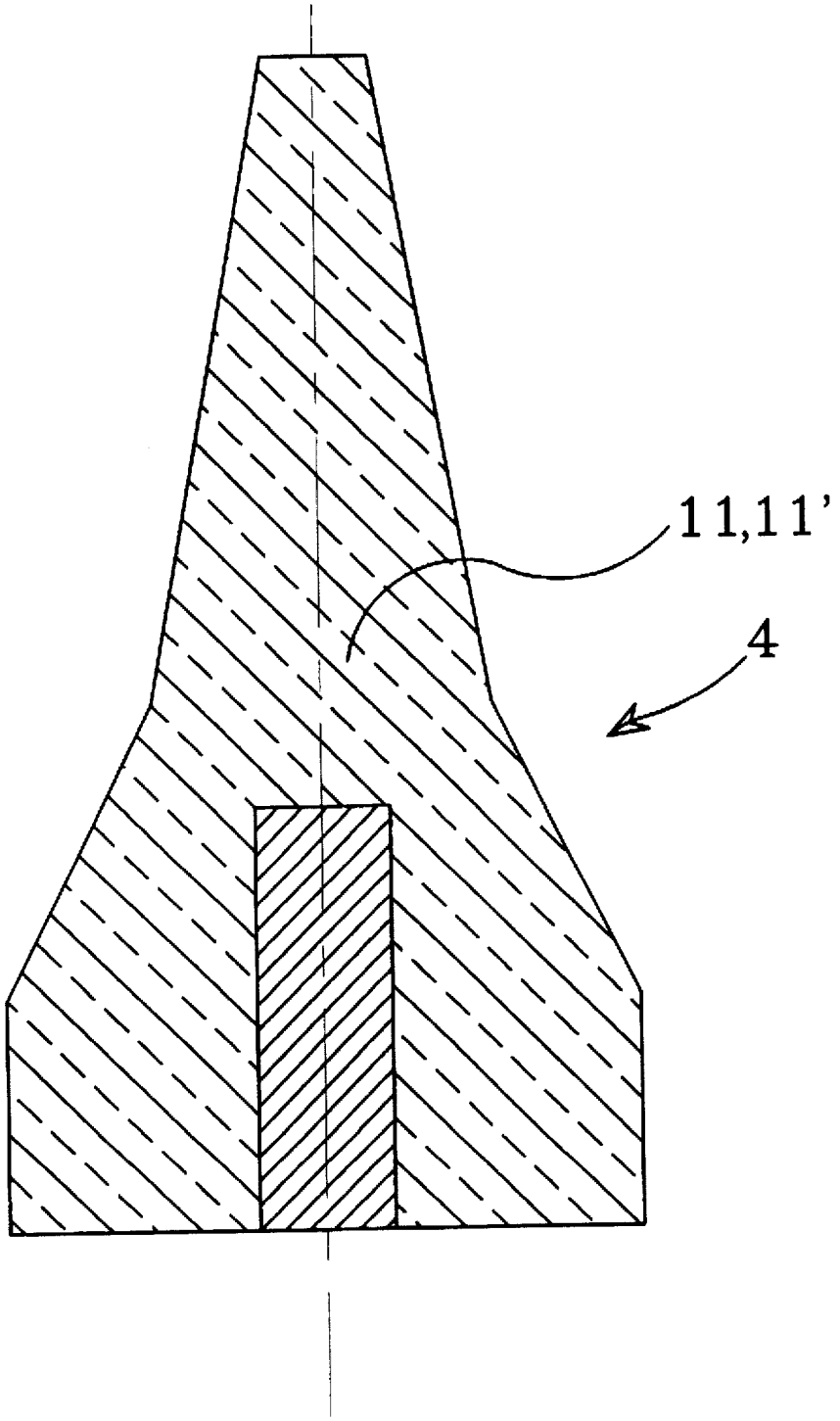
FIG. 4 is a schematic view of a road element to be transported by the method and device in accordance with the present invention.

Since in the device and method in accordance with the present invention, the cart is connected with the modular elements so that it is fixed to the articulation between the two successive modular elements 4, the invention can be used for modular elements of all forms, including a non-aggressive, non-fragile form which is easy to manufacture as shown for example in FIG. 3. Of course, the present invention can be used for all existing modular elements as well. If the barrier formed by the modular elements is intended to rest in place for a certain period of time, the shaft 8 can be easily dismantled by unscrewing the nut 15, and the suspension device formed by the cart 16 and the shaft 8 can be removed. The shaft 8 can be then replaced by conventional axles of articulation.

The transfer of the modular elements in accordance with the present invention is performed in a simple and fast manner. The widened end 3 or 3' of the guiding element 1 is brought in alignment with the cart 7 of the first modular element for the barrier to be displaced and the guiding element 1 is moved longitudinally. The wheel 17 of the first cart 7 enter the funnel-shaped end portion 3 or 3'. When the vehicle continues to displace, the wheels 17 are introduced first in the linear portion 2 or 2' and then in the central curved C-shaped portion. After passing the central portion, the cart 16 moves along the other rectilinear portion 2' or 2. During this movement the cart carries the modular elements 4.

In accordance with the present invention, one rectilinear portion can be formed as an ascending portion, while the other rectilinear portion can be formed as a descending portion. In the shown embodiment the rectilinear portion 2 is formed as an ascending portion so that when the cart 16 is inserted into it, the modular elements are slightly raised above the ground. The central curved portion can be formed as a substantially horizontal portion. The other rectilinear portion 2' can be formed as a descending portion, so that the modular elements in the region of the descending portion 2' are lowered to the level of the ground. The transfer of the modular elements of the barrier from the location corresponding to the line B to the location corresponding to the line A is made by a reverse displacement of the guiding element 1. The funnel-shapes of the widenings 3 and 3' facilitate entering of the carts into the guiding element 1. It is also possible that the portions 2 and 2' as well as the central portion are located in the horizontal plane, while the ascending and the descending parts of the guiding element 1 are formed by the funnel-shaped ends 3 and 3' only.

When the cart 7 is displaced along the guiding element 1 and in particular in the areas between the rectilinear portion and the curved portion, and then between the curved portion and the rectilinear portion, the road elements 4 can turn relative to one another due to the articulation 9 and the shaft 8 extending through the circular holes 12 of the hinge 10 and the oblong holes 14 of the hinge 13. The length of the guiding element 1 can be very limited since it is only used to guide the carts 16 which are extremely easy to maneuver and therefore, a very complex vehicle can be utilized for displacement of the modular elements 4 having great length. The width of the guiding element 1 is determined by the distance between the locations identified with the lines A and B, which can be double or even triple width of the track, according to the total number of tracks.

It will be understood that each of the elements described above, or two or more together, may also find a useful application in other types of methods and constructions differing from the types described above.

While the invention has been illustrated and described as embodied in a method of and device for transferring road elements, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A device for transferring a plurality of road elements, comprising a substantially C-shaped hollow guiding element having two opposite ends spaced from one another in a transverse direction and a curved portion extending between said ends; a plurality of carts which are guided inside said guiding element along said guiding element for one of said ends to the other of said ends from each cart and so that when said guiding element is displaced in a longitudinal direction said carts are guidingly moved from one of said ends to the other of said ends; and means for connecting each of said carts with two successive road elements, so that during the displacement of said guiding element each of the two successive road elements are displaced by said carts from said one end to said other end of said guiding element, said connecting means including a substantially vertical shaft extending from each of said carts and adapted to be articulately connected with two successive road elements outside said two successive road elements, said connecting means including two hinges each adapted to be connected to a respective one of the two successive road elements and each having at least one opening, so that the openings of said hinges are in alignment with one another, said shaft of each of said cart elements passing through said aligned openings of said hinges, said opening of at least one of said hinges being formed as an oblong hole.

2. A device as defined in claim 1, wherein said guiding element has a C-shaped cross-section and is open downwardly so as to form two side blades separated from one another by a slot, each of said carts being provided with wheels guided on said blades, said shaft of each of said carts extending through said slot.

3. A device as defined in claim 1, wherein said shaft of each of said carts is turnable about a substantially vertical axis.

4. A device as defined in claim 1, wherein each of said carts has a frame with at least two wheels turnable about a substantially horizontal axis.

5. A device as defined in claim 1, wherein each of said hinges is U-shaped and has two legs and a connecting portion, said connecting portion of each of said hinges being connectable with a respective one of the two successive road elements, said legs of each of said hinges being provided with a corresponding one of said openings.

6. A device as defined in claim 1, wherein each of said carts has a frame having a lower longitudinal window through which said shaft passes.

7. A device as defined in claim 1, wherein at least one of said ends is formed as an ascending portion while the other of said ends is formed as a descending portion, so that when a corresponding one of the carts with the two successive road elements is in said ascending portion, said connecting means adapted to be connected to two successive road element is lifted so that the two successive road elements are lifted from the ground, and when the corresponding one of said carts is in said descending portion, said connected means adapted to be connected to two successive road elements is lowered so that the two successive road elements are placed back on the ground.

8. A device as defined in claim 1, wherein at least one of said ends of said guiding element is funnel-shaped, so as to facilitate entering of said carts into said guiding element.

9. A transferable road structure, comprising a plurality of road elements having substantially upright walls facing one another; and means for engaging said road elements by a transferring device for transferring said road elements from one location to another, said means including a first hinge element arranged on the upright wall of one of said road elements and a second hinge element arranged on the upright wall of another of said elements and connectable with said first hinge element turnably about a substantially upright axis, said hinge elements including holes alignable with one another so that a member of the transferring device can pass through said aligned holes and said hinge elements can be lifted by the member for transferring the road elements, the holes of at least one of said hinge elements being oblong in a substantially horizontal direction.

10. A transferable road structure as defined in claim 9, wherein said hinge elements are insertable in one another in a substantially horizontal direction.

* * * * *